US006951579B2

(12) United States Patent
Koyama

(10) Patent No.: US 6,951,579 B2
(45) Date of Patent: Oct. 4, 2005

(54) SINTERED ALLOY FOR VALVE SEATS, VALVE SEAT AND MANUFACTURING METHOD THEREOF

(75) Inventor: Yoshio Koyama, Kani (JP)

(73) Assignee: Teikoku Piston Ring Co., Ltd., Tokyo (JP)

( * ) Notice: Subject to any disclaimer, the term of this patent is extended or adjusted under 35 U.S.C. 154(b) by 132 days.

(21) Appl. No.: 10/370,782

(22) Filed: Feb. 24, 2003

(65) Prior Publication Data

US 2003/0177863 A1 Sep. 25, 2003

(30) Foreign Application Priority Data

Mar. 15, 2002 (JP) ..... 2002-071918

(51) Int. Cl.[7] ..... B22F 3/00

(52) U.S. Cl. ..... 75/231; 75/236; 75/246; 419/14; 419/27

(58) Field of Search ..... 75/231, 236, 246; 419/14, 27, 19

(56) References Cited

U.S. PATENT DOCUMENTS 4,363,662 A * 12/1982 Takahashi et al. ..... 75/243
4,505,988 A * 3/1985 Urano et al. ..... 428/569
5,031,878 A * 7/1991 Ishikawa et al. ..... 251/368
6,139,599 A * 10/2000 Takahashi et al. ..... 75/246
6,305,666 B1 * 10/2001 Sakai ..... 251/368
6,660,056 B2 * 12/2003 Hayashi et al. ..... 75/243

FOREIGN PATENT DOCUMENTS

| | | |
|---|---|---|
| EP | 0 481 763 A1 | 10/1991 |
| JP | 56-44123 | 10/1981 |
| JP | 57-19188 | 4/1982 |
| JP | 5-202451 | 8/1993 |
| JP | 3186816 | 5/2001 |

* cited by examiner

*Primary Examiner*—Ngoclan T. Mai
(74) *Attorney, Agent, or Firm*—Armstrong, Kratz, Quintos, Hanson & Brooks, LLP

(57) ABSTRACT

A sintered alloy for valve seats is comprised of carbon at 1 to 2 percent by weight, chromium at 3.5 to 4.7 percent by weight, molybdenum at 4.5 to 6.5 percent by weight, tungsten at 5.2 to 7.0 percent by weight, vanadium at 1.5 to 3.2 percent by weight, and the remainder of iron and unavoidable impurities. Enstatite particles at 1 to 3 percent by weight, hard alloy particles (A) with a Vickers hardness of 500 to 900 at 15 to 25 percent by weight, and hard alloy particles (B) with a Vickers hardness of 1000 or more at 5 to 15 percent by weight (A+B=35 percent by weight or less) are dispersed in the matrix of the sintered alloy skeleton distributed with carbide. Copper or copper alloy at 15 to 20 percent by weight is infiltrated into pores of the skeleton.

8 Claims, 1 Drawing Sheet

SINTERED ALLOY FOR VALVE SEATS, VALVE SEAT AND MANUFACTURING METHOD THEREOF

BACKGROUND OF THE INVENTION

1. Field of the Invention

The present invention relates to a sintered alloy for valve seats in internal combustion engines.

2. Description of the Related Art

Valve seats in internal combustion engines must have good heat-resistance and wear-resistance properties due to constant exposure to high temperature gases and repeated high-pressure contact with the valve. To achieve these properties, ferrous sintered alloys in which high alloy powder particles with high hardness are dispersed into the matrix to improve wear-resistance have been utilized. Further, in diesel engines running under severe heat conditions, and in gas engines not prone to produce products by combustion and oxidized film at the contact surface with the valve and easily prone to metal contact; a sintered alloy for valve seats with excellent wear-resistance was disclosed (Japanese Patent No. 3186816) using alloy tool steel powder at the matrix to raise the heat-resistance of the matrix; using multiple high alloy powder particles of differing hardness and calcium fluoride as a solid lubricant dispersed into the matrix, and in addition infiltrating copper or copper alloys into the pores of the base material to improve the strength and thermal conductivity of the sintered compact.

However, even better wear-resistance is required as diesel and gas engine output increases and service life grows longer.

SUMMARY OF THE INVENTION

In view of the above circumstances of the related art, the present invention therefore has the object of providing a sintered alloy for valve seats having high wear-resistance for use in high output diesel engines and gas engines.

The present invention employs the following means to achieve the above objects. Namely the sintered alloy for valve seats of the present invention comprises a skeleton containing distributed carbides and having the following elements:

| | |
|---|---|
| carbon: | 1.0 to 2.0 percent by weight |
| chromium: | 3.5 to 4.7 percent by weight |
| molybdenum: | 4.5 to 6.5 percent by weight |
| tungsten: | 5.2 to 7.0 percent by weight |
| vanadium: | 1.5 to 3.2 percent by weight |
| iron and unavoidable impurities: | remainder; |

wherein enstatite particles, hard alloy particles (A) with a Vickers hardness of 500 to 900, and hard alloy particles (B) with a Vickers hardness of 1000 or more are dispersed in the following proportions in the matrix of the skeleton:

| | |
|---|---|
| enstatite particles: | 1 to 3 percent by weight |
| hard alloy particles (A): | 15 to 25 percent by weight |
| hard alloy particles (B): | 5 to 15 percent by weight |
| ( A + B: | 35 percent by weight or less); |

and copper or copper alloy at 15 to 20 percent by weight is infiltrated into pores of the skeleton.

The matrix of the sintered alloy skeleton having the above composition and having carbides dispersed in the matrix provides improved wear-resistance and improved strength. Dispersing enstatite particles at 1 to 3 percent by weight as a heat-stable solid lubricant within the matrix yields improved wear-resistance under harsh lubricating conditions such as exposure to high temperature gases and metallic contact. The wear-resistance of the valve seat itself is improved and the wear on the mating valve is reduced by dispersing hard alloy particles (A) with a Vickers hardness of 500 to 900, and hard alloy particles (B) with a Vickers hardness of 1000 or more in the matrix of the skeleton in proportions of A: 15 to 25 percent by weight and B: 5 to 15 percent by weight (A+B: 35 percent by weight or less). The strength and the heat-resistance of the sintered compact can also be improved by infiltrating copper or copper alloys at 15 to 20 percent by weight into the pores of the skeleton. Therefore, compared to the conventional art, a sintered alloy for valve seats with even better wear-resistance under tough lubrication and heat environments can be obtained.

Carbon is contained in a solid solution state within the matrix to strengthen the matrix, and forms hard carbides of chromium, molybdenum, tungsten and vanadium that improve wear-resistance. Strength is inadequate if the proportion of carbon is less than 1 percent by weight and the compactibility is poor if the proportion exceeds 2.0 percent by weight. Chromium is contained in a solid solution state within the matrix to improve the heat-resistance, and improves the wear-resistance by forming carbides. Heat-resistance and wear-resistance are inadequate if the proportion of chromium is less than 3.5 percent by weight and wear on the sliding mating material increases if the proportions exceed 4.7 percent by weight. Molybdenum is contained in a solid solution state within the matrix to improve the heat-resistance, and improves the wear-resistance by forming carbides. Heat-resistance and wear-resistance are inadequate if the proportion of molybdenum is less than 4.5 percent by weight and wear on the sliding mating material increases if the proportions exceed 6.5 percent by weight. Tungsten is contained in a solid solution state within the matrix to improve the heat-resistance, and improves the wear-resistance by forming carbides. Heat-resistance and wear-resistance are inadequate if the proportion of tungsten is less than 5.2 percent by weight and wear on the sliding mating material increases if the proportions exceed 7.0 percent by weight. Vanadium forms a hard carbide and improves the wear-resistance. Wear-resistance is inadequate if the proportion of vanadium is less than 1.5 percent by weight and wear on the sliding mating material increases if the proportions exceed 3.2 percent by weight.

Enstatite particles (magnesium metasilicate powder) are a solid lubricant stable at high temperatures. Enstatite particles prevent the valve seat from making metallic contact with the valve and function to inhibit adhesive wear. Enstatite particles in proportions of less than 1 percent by weight is not very effective in reducing the amount of wear and in proportions of more than 3 percent by weight may lead to a drop in valve seat strength.

The two types of hard alloy particles (A) and (B) dispersing within the matrix improve the wear-resistance of the matrix. The wear on the matrix is large if only the hard alloy particles (A) with a Vickers hardness of 500 to 900 are utilized. Also, the wear on the mating valve is large if only the hard alloy particles (B) with a Vickers hardness of 1000 or more are utilized. Therefore these two types of hard alloy particles (A) and (B) are jointly utilized. If hard alloy particles (A) are used in a proportion of less than 15 percent by weight, the wear-resistance is inadequate. If the proportion exceeds 25 percent by weight, the compressibility is poor during molding of the powder and the service life of the metal mold is short. There is also a large amount of wear on the face of the mating valve. The hard alloy particles (B) have no effect if the proportion is less than 5 percent by weight. The compressibility is poor during molding of the powder and the service life of the metal mold is short if the proportion of the hard alloy particles (B) exceeds 15 percent by weight. There is also a large amount of wear on the face of the mating valve. Moreover, if the total proportion of these two types of hard alloy particles (A) and (B) exceeds 35 percent by weight, then the flowability of the powder is poor, powder molding is difficult and large irregularities in weight occur during molding.

The sintered compact comprised as described above has pores. By infiltrating copper or copper alloy into the pores at 15 to 20 percent by weight depending on the quantity of pores, the strength and thermal conductivity of the sintered compact can be increased and the wear-resistance and heat-resistance also improved. If the proportion of copper or copper alloy is less than 15 percent by weight, then a sufficient effect can not obtained. If the proportion of copper or copper alloy exceeds 20 percent by weight, then the copper overflows and manufacturability is poor.

The hard alloy particles (A) uses preferably alloy powders made in such a way that such as Fe—Cr, Fe—Mo, Fe—Nb, Ni, Co, and graphite are mixed in the following proportions, then melted, cast into steel ingots, and those steel ingots then physically pulverized and classified into alloy powders of 150 mesh or less:

| | |
|---|---|
| carbon: | 1 to 4 percent by weight |
| chromium: | 10 to 30 percent by weight |
| nickel: | 2 to 15 percent by weight |
| molybdenum: | 10 to 30 percent by weight |
| cobalt: | 20 to 40 percent by weight |
| niobium: | 1 to 5 percent by weight |
| iron and unavoidable impurities: | remainder. |

The mechanical properties of the hard alloy particles (A) including the Vickers hardness (500 to 900) can be adjusted as needed within the above element range. The alloy powder was disclosed in Japanese Patent Publication No. 57-19188 by the applicant of the present invention.

The hard alloy particles (B) are preferably ferromolybdenum particles of 200 mesh or less. However, if hard particles with a Vickers hardness of 1000 or more, then hard particles of a high alloy containing tungsten (C—Cr—W—Co alloy or C—Cr—W—Fe alloy) may be used.

An example of a manufacturing method for the above sintered alloy for valve seats is shown next. Namely:

| | |
|---|---|
| carbon powder: | 0.7 to 1.0 percent by weight |
| enstatite particles: | 1 to 3 percent by weight |
| hard alloy particles (A) with a Vickers hardness of 500 to 900: | 15 to 25 percent by weight |
| hard alloy particles (B) with a Vickers hardness of 1000 or more: | 5 to 15 percent by weight |
| (hard alloy particles (A + B): | 35 percent by weight or less) |

and the remaining portion of high speed tool steel powder containing carbon at 0.4 to 0.6 percent by weight; are mixed and after compression molding, copper or copper alloy infiltration is performed simultaneously with sintering. Infiltration may be performed after sintering.

This manufacturing method has excellent compactibility and ample matrix density. Incidentally, the compactibility is poor and matrix density is inadequate if high speed tool steel powder containing carbon at 0.7 to 1.1 percent by weight is used.

BRIEF DESCRIPTION OF THE DRAWINGS

The aforesaid and other objects and features of the present invention will become more apparent from the following detailed description and the accompanying drawings.

DESCRIPTION OF THE PREFERRED EMBODIMENTS

Figure 1:
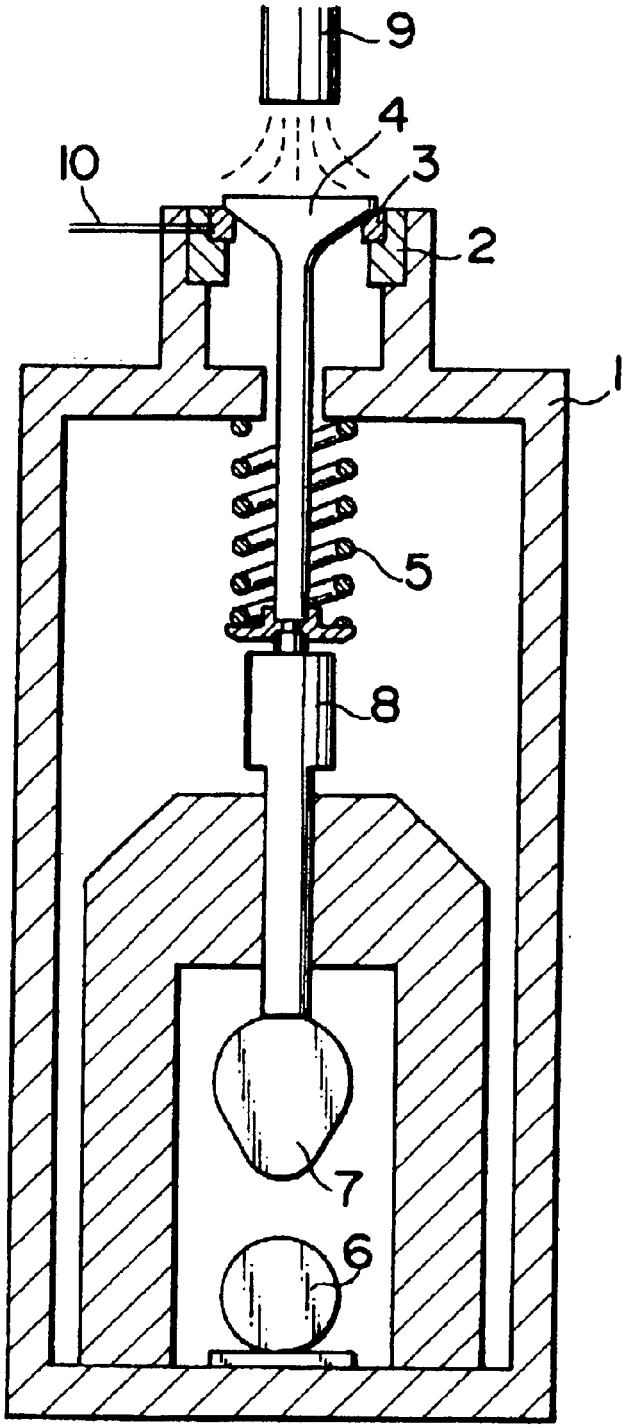
FIG. 1 is a vertical cross sectional view showing the valve seat wear testing machine.

Preferred embodiments for the present invention are next explained.

A source material powder for use in manufacturing the sintered alloy for the embodiment and comparative example is prepared. High speed tool steel powder, carbon powder and low alloy steel powder are prepared as the material composing the matrix of the ferrous sintered alloy skeleton. The low carbon high speed tool steel powder is comprised of:

| | |
|---|---|
| carbon: | 0.5 percent by weight |
| chromium: | 4.0 percent by weight |
| molybdenum: | 5.0 percent by weight |
| tungsten: | 6.0 percent by weight |
| vanadium: | 2.0 percent by weight |
| iron and unavoidable impurities: | remainder. |

The maximum particle size is 150 micrometers and the average particle size is 45 micrometers.

Enstatite powder particles with a maximum particle size of 105 micrometers and an average particle size of 11 micrometers are prepared. A comparative example powder using $CaF_2$ particles with a maximum particle size of 150 micrometers and an average particle size of 45 micrometers is prepared.

The hard alloy particles (A) uses alloy powders made in such a way that Fe—Cr, Fe—Mo, Fe—Nb, Ni, Co, and graphite are mixed in the following proportions, then melted, cast into steel ingots, and those steel ingots physically pulverized and classified into alloy powders of 150 mesh or less:

| | |
|---|---|
| carbon: | 2 percent by weight |
| chromium: | 20 percent by weight |
| nickel: | 8 percent by weight |
| molybdenum: | 20 percent by weight |
| cobalt: | 32 percent by weight |
| niobium: | 2 percent by weight |
| iron and unavoidable impurities: | remainder. |

In this way, hard alloy particles (A) having a Vickers hardness of 600 to 800 with a maximum particle size of 100 micrometers and an average particle size of 50 micrometers are prepared.

Hard alloy particles (B) of low-carbon ferromolybdenum powder having a Vickers hardness of 1300, a maximum particle size of 75 micrometers and an average particle size of 30 micrometers are prepared.

These source materials are prepared in the specified proportions as shown in Table 1, zinc stearate at 0.8 percent by weight is added, compression molding at a compression force of 6.9 tons per $cm^2$ performed and a green compact formed (density: 6.3 to 6.5 grams per $cm^3$, ring-shape). This green compact is sintered for 30 minutes at a temperature of 1130 degrees Centigrade in an ammonia cracking gas atmosphere. A specified quantity of the copper alloy for infiltration (for example, Cu—Fe—Mn alloy) is placed on the upper portion of the sintered compact and infiltration performed for 30 minutes at a temperature of 1110 degrees Centigrade.

The sintered alloy ring (valve seat) thus obtained is subjected to quenching including sub-zero processing and tempering to form the matrix having tempered martensite structures. This processing helps prevent the valve seat from coming out of the cylinder head.

TABLE 1

| | Sample No | Alloy steel powder for matrix wt. % | Solid lubricant powder: Solid lubricant | Solid lubricant powder: Content wt. % | Hard alloy particle powder: A wt. % | Hard alloy particle powder: B wt. % | Carbon powder wt. % | Infiltration amount of copper alloy wt. % |
|---|---|---|---|---|---|---|---|---|
| Embodiment | 1 | 67.1 | enstatite | 2.0 | 20.0 | 10.0 | 0.9 | 18.0 |
| | 2 | 78.1 | enstatite | 1.0 | 15.0 | 5.0 | 0.9 | 18.0 |
| | 3 | 68.1 | enstatite | 1.0 | 20.0 | 10.0 | 0.9 | 18.0 |
| | 4 | 66.1 | enstatite | 3.0 | 20.0 | 10.0 | 0.9 | 18.0 |
| | 5 | 72.1 | enstatite | 2.0 | 15.0 | 10.0 | 0.9 | 18.0 |
| | 6 | 62.1 | enstatite | 2.0 | 25.0 | 10.0 | 0.9 | 18.0 |
| | 7 | 72.1 | enstatite | 2.0 | 20.0 | 5.0 | 0.9 | 18.0 |
| | 8 | 62.1 | enstatite | 2.0 | 20.0 | 15.0 | 0.9 | 18.0 |
| | 9 | 67.3 | enstatite | 2.0 | 20.0 | 10.0 | 0.7 | 18.0 |
| | 10 | 67.0 | enstatite | 2.0 | 20.0 | 10.0 | 1.0 | 18.0 |
| | 11 | 67.1 | enstatite | 2.0 | 20.0 | 10.0 | 0.9 | 16.0 |
| | 12 | 67.1 | enstatite | 2.0 | 20.0 | 10.0 | 0.9 | 20.0 |
| Comparative Example | 13 | 57.0 | enstatite | 2.0 | 20.0 | 10.0 | 0.9 | 18.0 |
| | 14 | 69.1 | — | 0 | 20.0 | 10.0 | 0.9 | 18.0 |
| | 15 | 65.1 | enstatite | 4.0 | 20.0 | 10.0 | 0.9 | 18.0 |
| | 16 | 77.1 | enstatite | 2.0 | 10.0 | 10.0 | 0.9 | 18.0 |
| | 17 | 57.1 | enstatite | 2.0 | 30.0 | 10.0 | 0.9 | 18.0 |
| | 18 | 77.1 | enstatite | 2.0 | 20.0 | 0 | 0.9 | 18.0 |
| | 19 | 57.1 | enstatite | 2.0 | 20.0 | 20.0 | 0.9 | 18.0 |
| | 20 | 67.5 | enstatite | 2.0 | 20.0 | 10.0 | 0.5 | 18.0 |
| | 21 | 66.7 | enstatite | 2.0 | 20.0 | 10.0 | 1.3 | 18.0 |
| | 22 | 67.1 | enstatite | 2.0 | 20.0 | 10.0 | 0.9 | 14.0 |
| | 23 | 67.1 | enstatite | 2.0 | 20.0 | 10.0 | 0.9 | 22.0 |
| | 24 | 68.0 | enstatite | 2.0 | 20.0 | 10.0 | 0 | 18.0 |
| | 25 | 10.0 | — | 0 | 25.0 | 5.0 | 0.6 | 18.0 |
| | 26 | 10.0 | $CaF_2$ | 3.0 | 25.0 | 5.0 | 0.6 | 18.0 |

Sample numbers 1 through 12 in Table 1 are sintered alloys for valve seats comprised of:

| | |
|---|---|
| carbon: | 1.0 to 2.0 percent by weight |
| chromium: | 3.5 to 4.7 percent by weight |
| molybdenum: | 4.5 to 6.5 percent by weight |
| tungsten: | 5.2 to 7.0 percent by weight |
| vanadium: | 1.5 to 3.2 percent by weight |
| iron and unavoidable impurities: | remainder; |

wherein enstatite particles and hard alloy particles (A) with a Vickers hardness of 500 to 900, and hard alloy particles (B) with a Vickers hardness of 1000 or more are dispersed in the following proportions in the matrix of the sintered alloy skeleton distributed with carbides:

| | |
|---|---|
| enstatite particles: | 1 to 3 percent by weight |
| hard alloy particles (A): | 15 to 25 percent by weight |
| hard alloy particles (B): | 5 to 15 percent by weight |
| A + B: | 35 percent by weight or less); |

and copper or copper alloy at 15 to 20 percent by weight is infiltrated into the pores of the skeleton.

In Table 1, the alloy steel powder for matrix is a low-carbon high speed tool steel powder comprised of the following elements for embodiments 1 through 12 and comparative examples 13 through 23:

| | |
|---|---|
| carbon: | 0.5 percent by weight |
| chromium: | 4 percent by weight |
| molybdenum: | 5 percent by weight |
| tungsten: | 6 percent by weight |
| vanadium: | 2 percent by weight |
| iron and unavoidable impurities: | remainder. |

The alloy steel powder for matrix used in the comparative example 24 is a high speed tool steel powder comprised of the following elements:

| | |
|---|---|
| carbon: | 0.8 percent by weight |
| chromium: | 4 percent by weight |
| molybdenum: | 5 percent by weight |
| tungsten: | 6 percent by weight |

-continued

| | |
|---|---|
| vanadium: | 2 percent by weight |
| iron and unavoidable impurities: | remainder. |

The alloy steel powder for matrix used in comparative examples 25 and 26 is an alloy tool steel powder (JIS SKD11).

In Table 1, the respective percentages by weight for the alloy steel powder for matrix, solid lubricant powder, hard alloy particle powder and carbon powder are for an alloy steel powder for matrix, solid lubricant powder, hard alloy particle powder and carbon powder content totaling 100 percent. In cases where the alloy steel powder for matrix, solid lubricant powder, hard alloy particle powder and carbon powder total less than 100 percent, the remainder is a low alloy steel powder comprised of the following elements:

| | |
|---|---|
| nickel: | 4 percent by weight |
| molybdenum: | 1.5 percent by weight |
| copper: | 2 percent by weight |
| carbon: | 0.02 percent by weight |
| iron and unavoidable impurities: | remainder. |

The percentage by weight for the infiltration amount of copper alloy is a figure where the sintered alloy skeleton and copper alloy infiltration amount percentages by weight together amount to a total of 100 percent.

The wear tests are described next.

The wear on the faces of the sintered alloy ring (valve seat) and mating material (valve) was rated under the following conditions with the valve seat wear testing machine shown in FIG. 1 and the amount of wear from the resulting shapes was measured.

Test Conditions:

| | |
|---|---|
| valve material: | Heat-resistant steel (tufftriding on steel, JIS SUH11) |
| Valve seat temperature: | 300 degrees Centigrade |
| camshaft rotation speed: | 2500 rpm |
| testing time: | 5 hours |

The valve seat wear testing machine is configured as shown in FIG. 1. The face of a valve 4 makes contact by means of a spring 5, with a valve seat 3 fitted in a seat holder 2 on the top edge of a frame body 1. The valve 4 is pushed upward by way of a rod 8 via a camshaft 7 rotated by an electric motor 6. The valve 4 then makes contact with the valve seat 3 by the return action of the spring 5. The valve 4 is heated by a gas burner 9, and the temperature of the valve seat 3 measured by a thermocouple 10 and the temperature monitored. During heating of the valve 4, the gas burner is adjusted for complete combustion so that an oxidized film does not occur on the surface. Actual engine parts were utilized as the valve 4, spring 5, camshaft 7 and rod 8, etc.

The radial crushing strength test is described next.

The radial crushing strength of the valve seat was rated by a method based on JIS Z 2507 and determined by the following formula.

$$\text{Radial crushing strength}=2F*(D1+D2)/L*(D1-D2)^2$$

Here, F is the maximum load at destruction (N), D1 is the outer diameter (mm), D2 is the inner diameter (mm), L is the ring length (mm). The sample size was set at an outer diameter of 35 millimeters, an inner diameter of 25 millimeters and a ring length of 10 millimeters.

Test results are shown in Table 2.

TABLE 2

| | | Wear test result (micrometer) | | Radial crushing | |
|---|---|---|---|---|---|
| | | Valve sheet | Valve | strength MPa | Manufacturability |
| Embodiment | 1 | 25.3 | 3.8 | 705 | Good |
| | 2 | 38.0 | 3.6 | 883 | Good |
| | 3 | 36.5 | 3.8 | 848 | Good |
| | 4 | 16.9 | 2.5 | 684 | Good |
| | 5 | 33.0 | 3.9 | 735 | Good |
| | 6 | 17.0 | 2.9 | 619 | Good |
| | 7 | 36.0 | 3.1 | 735 | Good |
| | 8 | 15.0 | 3.2 | 609 | Good |
| | 9 | 27.0 | 3.6 | 657 | Good |
| | 10 | 27.2 | 3.9 | 725 | Good |
| | 11 | 28.1 | 3.2 | 650 | Good |
| | 12 | 29.1 | 3.4 | 745 | Good |
| Comparative Example | 13 | 49.0 | 3.5 | 745 | Good |
| | 14 | 66.3 | 3.6 | 863 | Good |
| | 15 | 19.5 | 2.2 | 481 | Good |
| | 16 | 49.0 | 3.2 | 765 | Good |
| | 17 | 23.0 | 5.6 | 510 | Poor |
| | 18 | 51.0 | 3.0 | 775 | Good |
| | 19 | 21.4 | 6.2 | 490 | Poor |
| | 20 | 30.6 | 3.4 | 500 | Good |
| | 21 | 48.0 | 3.6 | 600 | Poor |
| | 22 | 46.0 | 3.5 | 490 | Good |
| | 23 | 30.4 | 3.2 | 730 | Poor |
| | 24 | 32.0 | 3.7 | 510 | Poor |
| | 25 | 68.8 | 4.1 | 1146 | Good |
| | 26 | 53.8 | 3.4 | 899 | Good |

Sample No. 13 has a matrix composition of the sintered alloy skeleton wherein a low-alloy steel powder is added to the high speed tool steel powder. This sample has low valve seat wear-resistance.

Sample No. 14 has less enstatite particles than the specified range of the present invention. This sample has low valve seat wear-resistance.

Sample No. 15 has more enstatite particles than the specified range of the present invention. This sample has low valve seat strength.

Sample No. 16 has less hard alloy particles (A) than the specified range of the present invention. This sample has low valve seat wear-resistance.

Sample No. 17 has more hard alloy particles (A) than the specified range of the present invention. This sample has much valve wear and poor compactibility.

Sample No. 18 has less hard alloy particles (B) than the specified range of the present invention. This sample has low valve seat wear-resistance.

Sample No. 19 has more hard alloy particles (B) than the specified range of the present invention. This sample has much valve wear, low strength and poor compactibility.

Sample No. 20 has less carbon than the specified range of the present invention. This sample has low valve seat strength.

Sample No. 21 has more carbon than the specified range of the present invention. This sample has low valve sheet wear-resistance.

Sample No. 22 has a lower copper alloy infiltration amount than the specified range of the present invention. This sample has low valve seat wear-registance and also low strength.

Sample No. 23 has a higher copper alloy infiltration amount than the specified range of the present invention.

The copper alloy in this sample overflows so the manufacturability is poor.

Sample No. 24 has high speed steel (JIS SKH51, C: 0.8 percent by weight) as the alloy steel powder for matrix. This sample has poor compactibility during compression molding and also low strength.

Samples No. 25 and No. 26 contain alloy tool steel (JIS SKD11) at 10 percent by weight in the alloy steel powder for matrix. Sample No. 25 does not contain solid lubricant. Sample No. 26 has $CaF_2$ as the solid lubricant. Both samples No. 25 and No. 26 have low valve seat wear-resistance compared to the embodiments.

The valve seat of the present invention can be used in a first part of the dual-layer composite sintered valve seat disclosed in Japanese Patent Publication No. 56-44123. The valve seat of No. 56-44123 is comprised of a first part which contacts a valve and a second part. Both parts have different compositions.

Although the present invention has been described with reference to the preferred embodiments, it is apparent that the present invention is not limited to the aforesaid preferred embodiments, but various modifications can be attained without departing from its scope.

What is claimed is:

1. A sintered alloy for valve seats comprising a skeleton having a matrix of a tempered martensite structure, containing distributed carbides and having the following elements:

| | |
|---|---|
| carbon: | 1.0 to 2.0 percent by weight |
| chromium: | 3.5 to 4.7 percent by weight |
| molybdenum: | 4.5 to 6.5 percent by weight |
| tungsten: | 5.2 to 7.0 percent by weight |
| vanadium: | 1.5 to 3.2 percent by weight |
| iron and unavoidable impurities: | remainder; |

wherein enstatite particles, hard alloy particles (A) with a Vickers hardness of 500 to 900, and hard alloy particles (B) with a Vickers hardness of 1000 or more are dispersed in the following proportions in the matrix of said skeleton:

| | |
|---|---|
| enstatite particles: | 1 to 3 percent by weight |
| hard alloy particles (A): | 15 to 25 percent by weight |
| hard alloy particles (B): | 5 to 15 percent by weight |
| (A + B: | 35 percent by weight or less); |

and copper or copper alloy at 15 to 20 percent by weight is infiltrated into pores of said skeleton.

2. A sintered alloy for valve seats as claimed in claim 1, wherein said hard alloy particles (A) are alloy particles comprised of the following elements:

| | |
|---|---|
| carbon: | 1.0 to 4.0 percent by weight |
| chromium: | 10 to 30 percent by weight |
| nickel: | 2 to 15 percent by weight |
| molybdenum: | 10 to 30 percent by weight |
| cobalt: | 20 to 40 percent by weight |
| niobium: | 1 to 5 percent by weight |
| iron and unavoidable impurities: | remainder; |

and said hard alloy particles (B) are ferromolybdenum particles.

3. A valve seat of said sintered alloy as claimed in claim 1.

4. A valve seat of said sintered alloy as claimed in claim 2.

5. A manufacturing method for said sintered alloy for valve seats as claimed in claim 1, comprising:

mixing carbon powder at 0.7 to 1.0 percent by weight;

enstatite particles at 1 to 3 percent by weight;

hard alloy particles (A) with a Vickers hardness of 500 to 900 at 15 to 25 percent by weight;

hard alloy particles (B) with a Vickers hardness of 1000 or more at 5 to 15 percent by weight;

(total hard alloy particles (A+B) at 35 percent by weight or less); and high speed tool steel powder containing carbon at 0.4 to 0.6 percent by weight as the remainder, to form a mixture;

compression molding the mixture, and infiltrating the compression molded mixture with copper or copper alloy while simultaneously sintering the mixture.

6. A manufacturing method for said sintered alloy for valve seats as claimed in claim 1, comprising:

mixing carbon powder at 0.7 to 1.0 percent by weight;

enstatite particles at 1 to 3 percent by weight;

hard alloy particles (A) with a Vickers hardness of 500 to 900 at 15 to 25 percent by weight;

hard alloy particles (B) with a Vickers hardness of 1000 or more at 5 to 15 percent by weight;

(total hard alloy particles (A+B) at 35 percent by weight or less); and high speed tool steel powder containing carbon at 0.4 to 0.6 percent by weight as the remainder, to form a mixture;

compression molding the mixture, sintering the compression molded mixture, and then infiltrating the sintered compression molded mixture with copper or copper alloy.

7. A manufacturing method for said sintered alloy for valve seats as claimed in claim 2, comprising:

mixing carbon powder at 0.7 to 1.0 percent by weight;

enstatite particles at 1 to 3 percent by weight;

hard alloy particles (A) with a Vickers hardness of 500 to 900 at 15 to 25 percent by weight;

hard alloy particles (B) with a Vickers hardness of 1000 or more at 5 to 15 percent by weight;

(total hard alloy particles (A+B) at 35 percent by weight or less); and high speed tool steel powder containing carbon at 0.4 to 0.6 percent by weight as the remainder, to form a mixture;

compression molding the mixture, and infiltrating the compression molded mixture with copper or copper alloy while simultaneously sintering the mixture.

8. A manufacturing method for said sintered alloy for valve seats as claimed in claim 2, comprising:

mixing carbon powder at 0.7 to 1.0 percent by weight;

enstatite particles at 1 to 3 percent by weight;

hard alloy particles (A) with a Vickers hardness of 500 to 900 at 15 to 25 percent by weight;

hard alloy particles (B) with a Vickers hardness of 1000 or more at 5 to 15 percent by weight;

(total hard alloy particles (A+B) at 35 percent by weight or less); and high speed tool steel powder containing carbon at 0.4 to 0.6 percent by weight as the remainder, to form a mixture;

compression molding the mixture, sintering the compression molded mixture, and then infiltrating the sintered compression molded mixture with copper or copper alloy.

* * * * *